United States Patent [19]

Fredrick

[11] 4,132,180

[45] Jan. 2, 1979

[54] APPARATUS AND METHOD FOR ENHANCING COMBUSTIBILITY OF SOLID FUELS

[76] Inventor: William L. Fredrick, 19938 Lassen, Chatsworth, Calif. 91324

[21] Appl. No.: 817,995

[22] Filed: Jul. 22, 1977

Related U.S. Application Data

[63] Continuation-in-part of Ser. No. 600,918, Jul. 31, 1975, abandoned.

[51] Int. Cl.[2] ..... F23C 5/12; F23M 9/00

[52] U.S. Cl. ..... 110/244; 110/264; 110/265; 431/185; 431/352; 241/39

[58] Field of Search ..... 431/185, 352, 9; 241/39, 5; 48/77, 203; 60/39.12; 110/106, 243, 244, 251, 252, 264, 265

[56] References Cited

U.S. PATENT DOCUMENTS

| | | | |
|---|---|---|---|
| 2,219,011 | 10/1940 | Kidwell et al. | 241/39 |
| 2,325,318 | 7/1943 | Hendrix | 431/185 |
| 3,030,773 | 4/1962 | Johnson | 431/9 |
| 3,199,476 | 8/1965 | Nettel | 110/265 |
| 3,472,185 | 10/1969 | Burden, Jr. | 110/244 |
| 3,589,315 | 6/1971 | Hart | 110/265 |
| 3,837,303 | 9/1974 | Baardson | 110/244 |
| 3,861,330 | 1/1975 | Santoleri | 110/244 |
| 4,060,041 | 11/1977 | Sowards | 110/264 |

*Primary Examiner*—Henry C. Yuen

*Attorney, Agent, or Firm*—Wills, Green & Mueth Law Corporation

[57] ABSTRACT

Apparatus and methods are provided for reducing solid combustible particles by heat and abrasion to a condition in which they can be burned completely and without the production of objectionable solid particulates in the exhaust gases. Solid combustible particles are carried into an outer chamber of the device by a low pressure transport air stream, with additional air at high pressure and high velocity being introduced into the same chamber in a relation driving the solid particles rapidly and circularly within the outer chamber and about an inner chamber of the device. Impingement of the particles against one another and/or the walls of the outer chamber during such swirling motion, supplemented by partial oxidation of the combustibles, raises the temperature of the particles and comminutes or reduces their sizes to form a very highly combustible flowable aerosol mass which will burst into flame when contacted by a stream of secondary combustion air. The combustion air may be mixed with the high temperature particle carrying stream at essentially the location of the discussed inner chamber of the device. The fuel air ratio in the apparatus may be closely controlled to attain optimum complete combustion of the particles. A start-up pilot flame may be provided in the outer chamber to assist in initially raising the temperature in that chamber. In addition, any non-combustible particles such as ash constituents of the fuel, may be ejected from the outer chamber through a special ejection outlet.

21 Claims, 6 Drawing Figures

FIG. 1
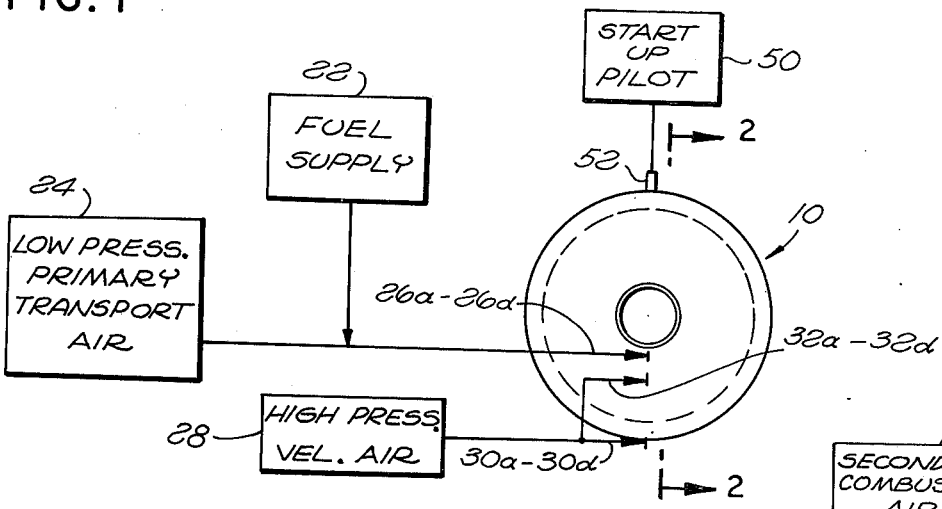
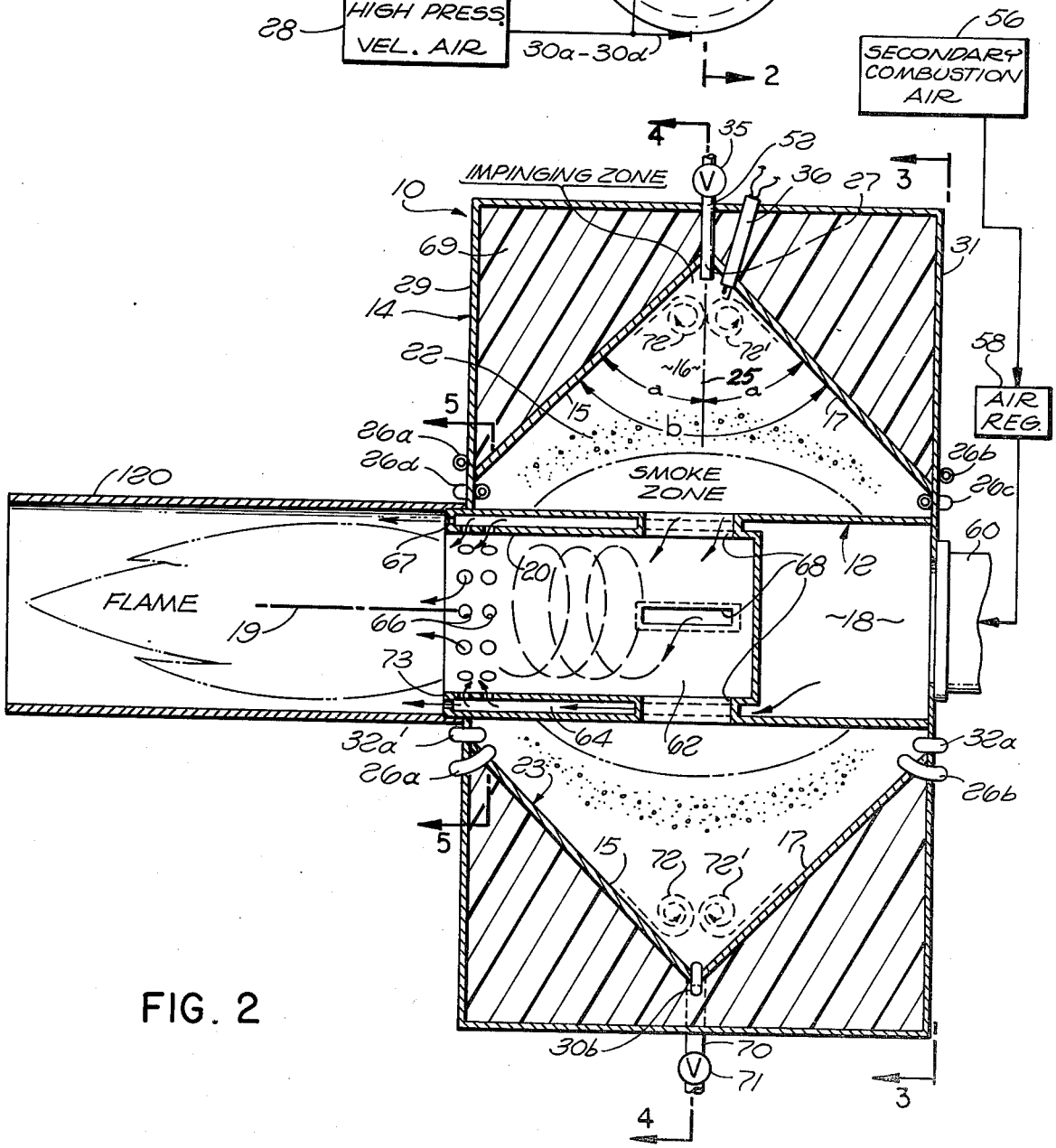
FIG. 2

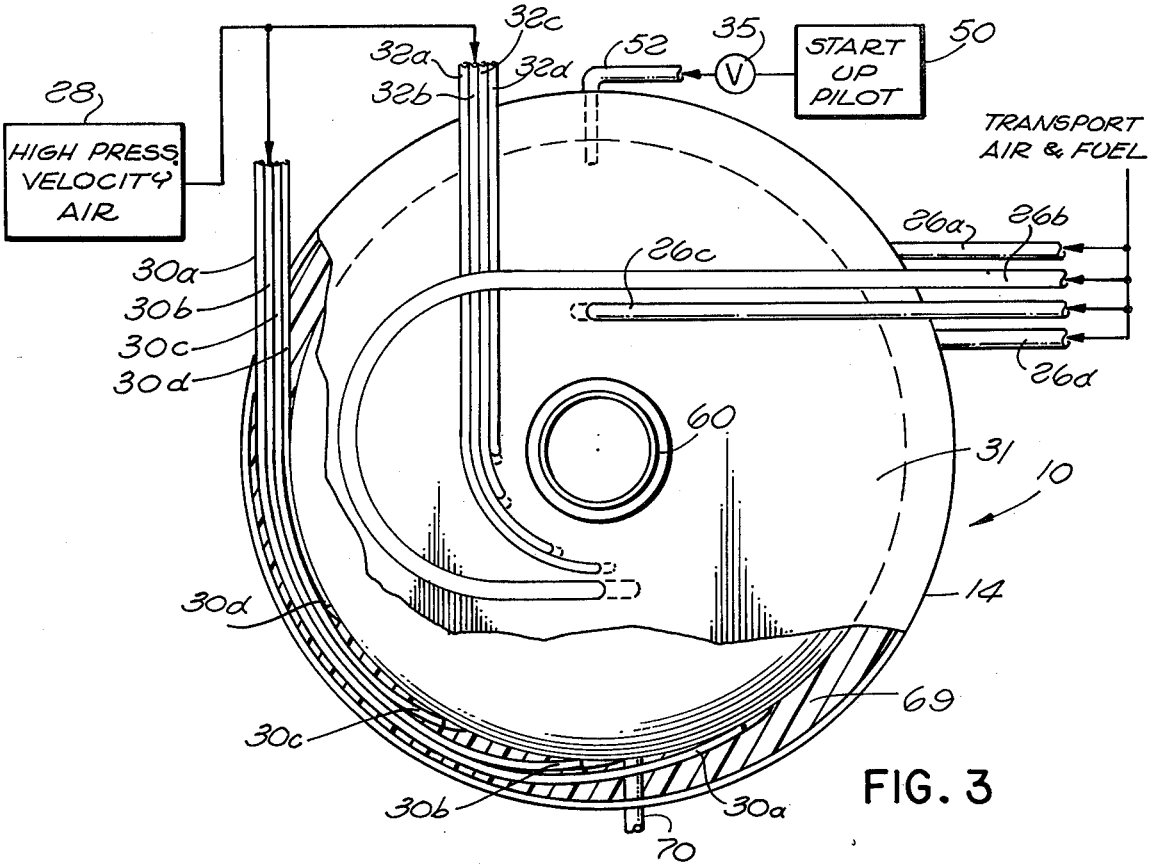
FIG. 3
FIG. 4
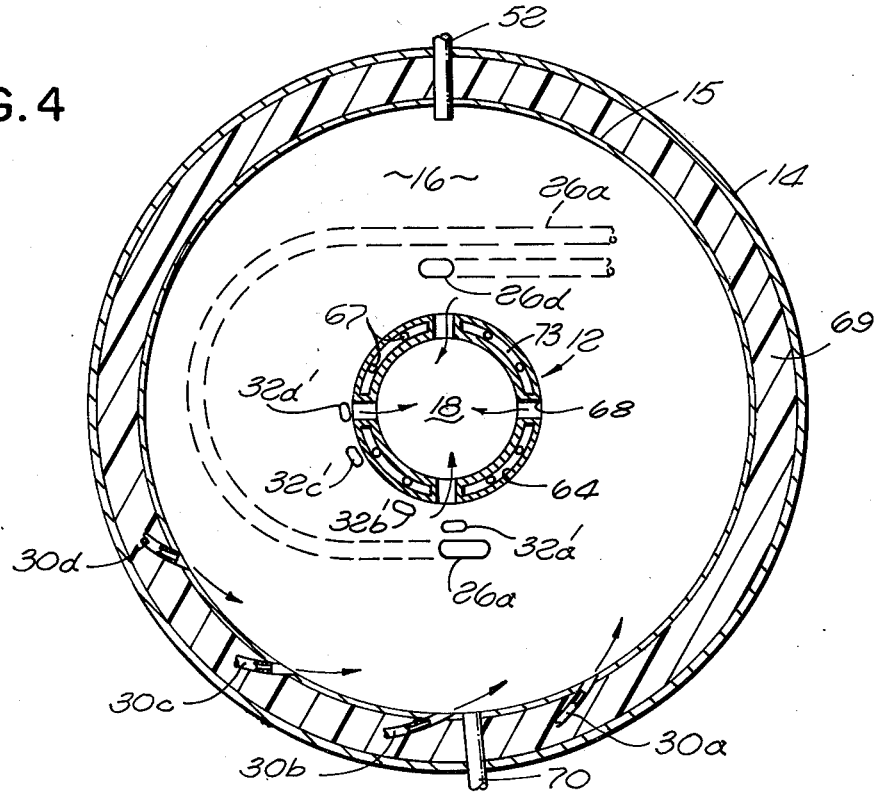

FIG. 5
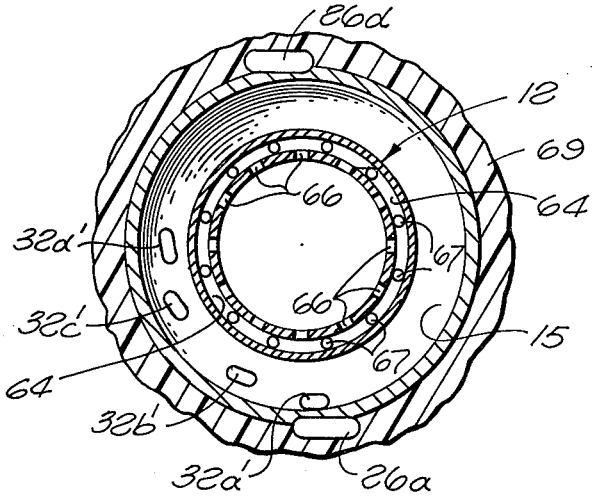
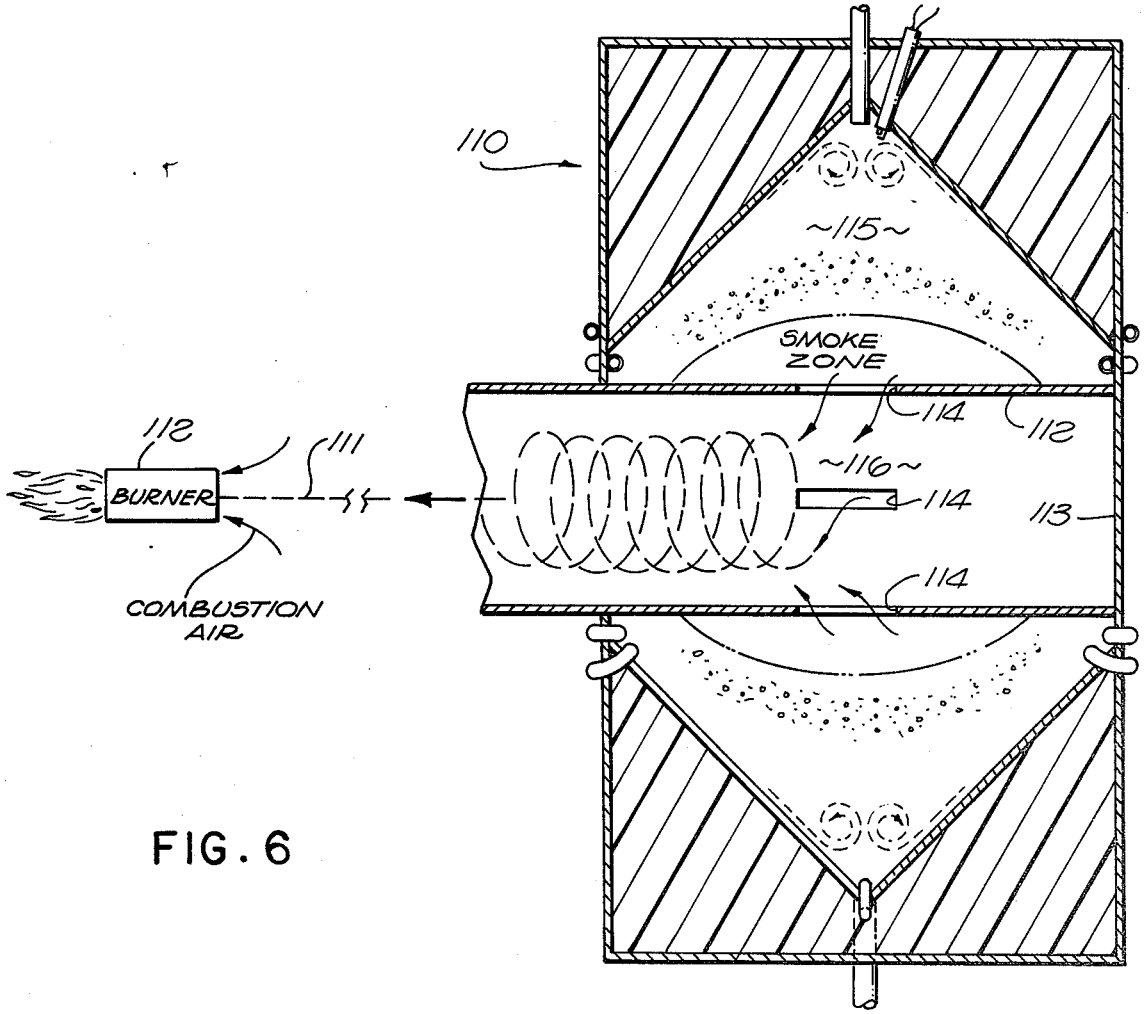
FIG. 6

APPARATUS AND METHOD FOR ENHANCING COMBUSTIBILITY OF SOLID FUELS

BACKGROUND OF THE INVENTION

The present application is a continuation-in-part of copending application Ser. No. 600,918, filed July 31, 1975, for "Solid Fuel Burner", now abandoned.

This invention relates to improved apparatus and methods for converting particles of a solid combustible material, such as coal, or a combustible biomass, e.g., ground bark, wood chips, or sawdust, to a condition of increased combustibility, preferably followed by actual burning of the materials in a complete and substantially smokeless manner.

The effective and complete burning of a solid combustible fuel without the production of objectionable exhaust gases or particles is of course much more difficult than is the complete burning of a gaseous or liquid fuel. Various expedients have been proposed in the past for attempting to reduce such solid combustibles to a form capable of combustion in a fairly complete manner. For example, cyclone furnace and similar devices for this purpose are shown in U.S. Pat. Nos. 1,836,627, 2,325,318, 2,636,388, 2,706,707, 3,124,086 and 3,856,455.

SUMMARY OF THE INVENTION

A principal object of the invention is to provide apparatus and methods of the above discussed general type for converting solid combustible particles in a stream of air or other transport gas to an extremely finely divided form, at a relatively high temperature, so that the resultant flowable mass of smokey hot gases can be burned completely when contacted by additional combustion air. If non-combustible particles are initially intermixed with or are a part of the combustible fuel, the present invention provides a means of separating out and burning the combustibles, and enjecting the non-combustibles. The combustible particles initially can be of relatively large size, and before introduction into the apparatus need not be pulverized as completely as is necessary in most conventional equipment. Further, combustibles (such as sawdust) too small for combustion in conventional apparatus have been completely combusted in a device constructed in accordance with the present invention with no significant amount of particulates being carried off with the gaseous combustion products.

Even if the combustible particles as originally fed to the apparatus contain substantial amounts of moisture, for example up to or exceeding (20%) mositure content, a unit embodying the invention is still capable of effectively pyrolyzing the combustible particles and reducing them to the desired completely and smokelessly combustible form.

In the operation of the device, the individual particles are driven rapidly in a circular path about an inner chamber of the device and within an outer chamber surrounding said inner chamber, with this spinning or swirling motion continuing until the particles begin to decompose by collision and pyrolysis and achieve a finely divided smokelike condition, in which condition the high temperature gases and entrained combustible particles flow into the inner chamber. In one preferred arrangement, additional combustion air is supplied at essentially the location of the inner chamber, to cause the high temperature flowing mass of gases and combustible particles to burst into flame at that location. If desired, the high temperature essentially gaseous flowing mass can be directed through a conduit to a remote location, and ignited at that point. In either event, the fuel-air ratio is controllable so that complete combustion occurs and a substantially smoke-free gas is ultimately expelled from the apparatus.

BRIEF DESCRIPTION OF THE DRAWINGS

FIG. 1 is a schematic representation of a burner system embodying the invention;

FIG. 2 is an enlarged axial section through the burner, taken essentially along line 2—2 of FIG. 1;

FIG. 3 is an end elevation taken essentially on line 3—3 of FIG. 2;

FIG. 4 is a reduced scale transverse section taken on line 4—4 of FIG. 2;

FIG. 5 is a section taken on line 5—5 of FIG. 2; and

FIG. 6 is a view similar to FIG. 2, but showing a variational form of the invention to be used as a gasification type unit for supplying a stream of flammable gases and entrained combustible particles to a remote location.

DESCRIPTION OF THE PREFERRED EMBODIMENT

A burner embodying the teachings of the present invention is represented generally at 10 in the drawings, and includes a centrally located, generally tubular member 12 which is centered about an axis 19 and extends through a housing 14 to form a passage 18 through the housing. The housing 14 defines an outer chamber 16 which may be described as having a generally toroidal shape, and which extends around the central passage 18 formed by tubular member or tube 12. An outlet tube 120 may be fitted to the end of tube 12 and extend coaxially therewith, and an additional tubular member 20, containing and defining an inner chamber 62, may be mounted within tube 12 in radially spaced coaxial relation thereto. It is contemplated that in various forms of the invention, the tubular member 120 may in some instances be omitted completely or have any of various different lengths other than that shown, to satisfy any particular application requirement for the heat source created by the burner.

Chamber 16 has an annular, radially extending outer wall 23 centered about axis 19 and surrounded by heat insulating material 69. Wall 23 is formed of two annular portions or halves 15 and 17 at opposite sides of a central transverse plane 25 which is perpendicular to axis 19. Portions 15 and 17 of the radially extending outer wall are shaped to advance or extend radially outwardly as they advance or extend in a direction toward one another and toward plane 25 to define at 27 a maximum diameter or apex portion of chamber 16. Walls 15 and 17 are desirably frusto-conical and disposed at a common angle a to plane 25.

The included angle b formed by the intersection of walls 15 and 17 is preferably between about 50° and 130°. In a presently preferred arrangement, the angle b is approximately 70°.

Particles of a solid combustible material, such as coal, wood, any biomass, or virtually and other combustible solid which can be conveniently reduced to particulate form, are derived from an appropriate fuel supply represented diagrammatically at 22 in FIG. 1. These particles are introduced into chamber 16 by a low pressure stream of primary transport air (or other gas) derived from an appropriate source represented at 24. This low pressure air stream may, for example, have a pressure of the order of 5 to 25 inches of water column pressure. The fuel particles suspended in the primary transport air stream are introduced tangentially into outer chamber 16 of unit 10 through a series of tubes 26*a*, 26*b*, 26*c* and 26*d* extending into the chamber 16 through its opposite end walls 29 and 31 as shown. Desirably, these lines enter chamber 16 at a location closely adjacent tube 12, and near the radially extending inner extremities of oppositely inclined walls 15 and 17.

High pressure, high velocity air from an appropriate source 28 is introduced into chamber 16 through a number of tubes 30*a*, 30*b*, 30*c* and 30*d* at the under side of the burner, and through two sets of tubes 32*a*, 32*b*, 32*c* and 32*d*, and 32*a*', 32*b*', 32*c*' and 32*d*' on the opposite sides of the burner. Tubes 30*a*, 30*b*, 30*c* and 30*d* extend into chamber 16 at circularly spaced locations as seen in FIG. 3, and all desirably at the maximum diameter or apex location 27 at which walls 15 and 17 interesect. It appears that the tubes located at the maximum diameter cause the greatest amount of turbulence, which results in the collision of the solid particles, with each other and with the walls 15 and 17.

Tubes or conduit lines 32*a*, 32*b*, 32*c* and 32*d* enter chamber 16 through its end wall 31 at circularly spaced locations (FIG. 3), and lines 32*a*', 32*b*', 32*c*' and 32*d*' enter chamber 16 through the opposite end wall 29 at corresponding locations. That is, lines 32*a*', 32*b*', 32*c*' and 32*d*' may be considered as located directly behind lines 32*a*, 32*b*, 32*c* and 32*d* respectively as viewed in FIG. 3. The discharge ends of all of the tubes 30*a*, 30*b*, 30*c*, 30*d*, 32*a*, 32*b*, 32*c*, 32*d*, 32*a*', 32*b*', 32*c*' and 32*d*' are directed tangentially into chamber 16, in the same direction as fuel inlet lines 26*a*, 26*b*, 26*c*, and 26*d* to create a swirling mixture of air and entrained particles traveling in a generally circular path about axis 19 and about tubes 12 and 20 and inner chamber 21. As shown in FIG. 2, two vortices 72 and 72' of swirling gases and particles are created on opposite sides of a central transverse plane 25, with the gases and particles in one vortex spinning in a direction opposite to the direction in which the gases and particles of the other vortex spin. The swirling particles of the two vortices strike each other in the inner surface of walls 15 and 17 at high speed and with substantial force near the maximum diameter location in chamber 16. The pressure of the high velocity air emitting from lines 30*a*, et cetera, may be between about 20 and 200 psi. As the high velocity air causes the solid fuel particles to be driven at high speed within chamber 16, in a generally circular path, but with the formation of the discussed high velocity vortices 72 and 72', the resulting impinging contact between different particles and especially between the particles of one vortex and the particles of the other vortex, raises the temperature of the particles, and by impact and attrition comminutes them.

In order to assist in initially raising the temperature of the air and particles within chamber 16, as when the burner is first placed in operation, there may be provided means for producing a start-up flame within chamber 16 as by burning a supplemental fuel. For example, liquid or gaseous fuel derived from an appropriate source 50 may be introduced into chamber 16 through a tube 52 under the control of a manually or otherwise operable valve 35, with a suitable igniter 36 being provided in the chamber adjacent the flame location.

During normal operation of the burner system, the total fuel-air ratio in chamber 16, including the air from both of the sources 24 and 28, is such that a fuel-rich mixture is maintained in chamber 16. Thus, the air introduced into chamber 16 does not provide enough oxygen for complete combustion or to support a flame, but does provide enough oxygen to accelerate pyrolysis of the solid combustible products by partially but not completely oxidizing the fuel particles.

By proper control of the amount of low pressure transport air, a temperature of between about 1000° and 1450° Fahrenheit is desirably maintained within chamber 16, and preferably between about 1400° and 1450° Fahrenheit. At temperatures of 1450° Fahrenheit and below, solid non-combustible particles do not change to a plastic or liquid state, and therefore they can be removed without difficulty through a tube 70 leading from chamber 16 at its maximum diameter location. A valve 71 may be connected into tube 70 and be of a type which functions when opened to pass particles from the maximum diameter portion of chamber 16, radially outwardly through tube 70 to an appropriate collection receptacle.

The decomposition of the solid combustible particles within chamber 16 through pyrolysis and physical impingement, creates in that chamber a swirling, highly combustible mass of hot smokey gases containing the combustible particles in an extremely finely divided and large surface area form. Secondary combustion air from an appropriate source 56 is introduced through a pressure regulator 58 to one end of the passage 18 in tube 12 through a line or conduit 60. This air flow axially along an annular passage 64 formed radially between tubes 20 and 12, and then into the hot gas and particulate stream through apertures 66 in tube 20 and apertures 67 formed in an end wall 73 of passage 64. Chamber 62 communicates with the outer chamber 16 through a series of circularly spaced short radially extending tubes 68, extending through and connecting to the side walls of both of the tubes 12 and 20.

The secondary combustion air may be introduced into passage 18, at approximately 5 to 30 inches of water column pressure, with the pressure in inner chamber 62 preferably being maintained at approximately 0 to 4 inches of water column pressure, and the pressure in chamber 16 preferably being approximately 5 to 25 inches of water column pressure. Thus, the hot gases containing the finely divided combustible particles pass from chamber 16 into chamber 62 through tubes 68 because of the pressure differential between these two chambers. Also, secondary combustion air is forced into the end section of chamber 62 from passage 64 through apertures or orifices 66 because of the pressure differential between passages 64 and 62. The introduction of secondary combustion air from passage 64 into chamber 62 causes auto-ignition of the hot gases flowing from chamber 62 past the orifices 66 because the temperature of the gases and the entrained minute particles is already well above the ignition temperature.

Preferably, chamber 62 does not contain a flame at any time during the operation of the burner. Instead, the flame produced by the operation of the burner is created only in the vicinity of orifices 66 and 67 leading from passage 64. Complete combustion occurs as an appropriate amount of secondary combustion air is united with the hot gases and entrained particles flowing from chamber 62, so that a substantially particulate-free or smokeless flame is emitted from the outlet of the burner at the left end of tube 20. Thus, the air regulator 58 may be controlled so that the secondary combustion air is present in exactly the right proportion to achieve a stoichiometric flame and a smokeless condition of the exhaust gases from the burner. Regulation of the secondary combustion air also serves to control the temperature of the exhaust gases from the burner.

Any non-combustible particles which may be brought into chamber 16 with the fuel or as part of the fuel are kept in suspension within the chamber at its maximum diameter location 27 by centrifugal force resulting from the rapid swirling motion produced by the velocity of air from source 28. Thus, any non-combustible particles in the chamber 16 are not forced into the chamber 62, but instead, may be intermittently withdrawn through the ejection tube or orifice 70 in housing 14.

FIG. 6 shows a variational arrangement in which a device 110 similar to unit 10 of FIG. 2 is not employed as a burner but instead is utilized as a gasification type unit for producing a flow of heated combustible pyrolysis gases containing finely divided combustible particles which can be directed through a line 111 to a burner 112 at a remote location, as for example, some fifty feet away from unit 110.

The unit 110 may be constructed substantially the same as unit 10 of FIG. 2, except that the inner tube 20 is omitted and the right-hand end of tube 112 as viewed in FIG. 6 is closed at 113. Apertures 114 corresponding to tubes 68 of FIG. 2 provide communication between outer chamber 115 (corresponding to chamber 16 of FIG. 2) and inner chamber 116 whose left-hand end is connected to line 111 which leads to the burner or other utilization device 112.

The introduction of fuel and air from sources such as those shown at 22, 24 and 28 in FIG. 1 may be the same in FIG. 6 as in the first form of the invention, with the resultant development of a swirling mass of high-temperature smokey gases, i.e. partially oxidized pyrolysis gases containing very finely divided combustible particles, in outer chamber 115. This high temperature mass flows radially inwardly from outer chamber 115 to inner chamber 116, for delivery at high temperature through line 111 to the burner 112 where combustion takes place upon contact of the high temperature mass with combustion air. Until the gases and entrained particles reach the burner location, the air-fuel ratio is not high enough to maintain combustion of the particles or any gases in the mixture.

While certain specific embodiments of the present invention have been disclosed as typical, the invention is of course not limited to these particular forms, but rather is applicable broadly to all such variations as fall within the scope of the appended claims.

I claim:

1. Apparatus for the pyrolysis and complete combustion of solid combustible particles comprising:

a housing having a central passage extending transversely therethrough and defining a chamber surrounding said passage and communicating therewith through at least one opening;

means for introducing a pressurized transport fluid stream and solid combustible particles into the chamber;

means for introducing a pressurized velocity fluid into the chamber in a direction to drive the solid combustible particles within the chamber around the central passage and raise the temperature of the combustible particles within the chamber to produce pyrolysis and to generate smoke; and means for introducing combustion air into one end of the passage so that complete combustion occurs as the combustion air is united with hot gases and smoke flowing from the chamber surrounding the passage.

2. The apparatus defined in claim 1, and which includes an elongated tubular member mounted in the housing to form said passage.

3. The apparatus defined in claim 2, in which the chamber has a generally toroidal shape and is coaxial with the central axis of the elongated tubular member.

4. The apparatus defined in claim 3, in which said velocity fluid introducing means causes the velocity fluid to be introduced tangentially into the chamber to cause the solid fuel particles to move in generally annular paths around the tubular member.

5. The apparatus defined in claim 1, and which includes a pipeline extending into the chamber for introducing a start-up pilot flame to the interior of the chamber.

6. The method that comprises:

introducing a pressurized transport gas carrying entrained solid combustible particles into a chamber at a location to flow therein essentially circularly about essentially a predetermined axis;

introducing a pressurized drive gas into said chamber at a location and velocity and in a direction to mix with the transport gas and drive it and the entrained particles rapidly along essentially circular paths;

directing said rapid circular flow of gases and particles along the inner side of a radially outer wall of the chamber having a maximum diameter portion and inwardly facing surfaces at opposite axial sides of said maximum diameter portion extending generally annularly about said axis and progressively increasing in diameter as they advance axially toward one another;

developing two vortices near said maximum diameter portion of said radially outer wall at which gases and particles which move along said two inwardly facing surfaces spin in opposite directions respectively;

abrading said particles to reduced size by virtue of the rapid movement of the particles within said chamber, including movement of the particles at said vortices;

raising the temperature of said particles in said chamber by engagement of the particles with one another and with the chamber walls, and by partial oxidation of said particles; and withdrawing said gases and entrained particles from a central location in said chamber.

7. The method as recited in claim 6, including introducing combustion air to said gases and entrained particles near the center of said chamber, and burning said particles completely by said combustion air.

8. The method as recited in claim 6, including transporting said gases and entrained particles to a location removed from said chamber; and intermixing combustion air with said gases and entrained particles at said removed location in proportions causing said particles to ignite and burn.

9. Apparatus comprising:

a structure containing an inner chamber and an outer chamber extending thereabout separated by an essentially tubular wall having opposite ends;

first means for introducing a pressurized transport gas carrying entrained solid combustible particles into said outer chamber at a location to produce a circumferential flow path about said wall and said inner chamber;

second means for introducing a pressurized drive gas into said outer chamber at a location and in a direction to mix with and drive said transport gas and entrained particles rapidly about said wall and said inner chamber in said flow path in a manner to cause said particles to be comminuted and result in the elevation of the temperature of the gases and particles;

at least one passageway located in said tubular wall through which said mixture of elevated temperature gases and entrained finely divided combustible particles can flow from said outer chamber to said inner chamber; and outlet means for discharging said mixture from said inner chamber.

10. Apparatus as recited in claim 9, in which said outer chamber is further defined by a generally annular wall extending radially about said tubular wall and having inwardly facing surfaces with a minimum diameter portion of said surfaces located adjacent each end of said tubular wall, said surfaces extending generally annularly about the outer chamber and progressively increasing in diameter in a direction axial toward one another to form a maximum diameter portion.

11. Apparatus as recited in claim 10, in which said second means include inlet means constructed to inject said drive gas into said outer chamber generally tangentially at essentially the location of said maximum diameter portion thereof, and additional inlet means acting to inject drive gas into said outer chamber near opposite sides of the outer chamber and closely adjacent said essentially tubular wall and minimum diameter portions of said inwardly facing surfaces.

12. Apparatus as recited in claim 9, including means for producing a start-up flame in said outer chamber.

13. Apparatus comprising:

a structure containing an inner chamber and an outer chamber extending thereabout separated by an essentially tubular wall having opposite ends;

first means for introducing a pressurized transport gas carrying entrained solid combustible particles into said outer chamber at a location to produce a circumferential flow path about said wall and said inner chamber;

second means for introducing a pressurized drive gas into said outer chamber at a location and in a direction to mix with and drive said transport gas and the entrained particles rapidly about said wall and said inner chamber in said flow path in a manner to cause said particles to collide and be reduced in size and result in the elevation of the temperature of the gases and particles but without complete combustion of the particles;

at least one passage in said tubular wall through which said mixture of high temperature gases and entrained finely divided combustible particles can flow from said outer chamber to said inner chamber; and means for introducing combustion air to said mixture of high temperature gases and entrained combustible particles adjacent said inner chamber and in a ratio to result in the burning of said particles and all combustibles in said mixed gases.

14. Apparatus as recited in claim 13, in which said last mentioned means include passage means for directing said combustion air through the interior of said outer chamber to a combustion location.

15. Apparatus as recited in claim 13, in which said last mentioned means include a second essentially tubular wall received within and spaced radially from said first mentioned essentially tubular wall and defining therewith a combustion air feed passage through which said combustion air flows to a combustion location.

16. Apparatus as recited in claim 13, in which said outer chamber has a generally annular radially outer wall with a maximum diameter portion and with inwardly facing surfaces at opposite axial sides of said maximum diameter portion which extend generally annularly about the outer chamber and progressively increase in diameter as they advance axially toward one another.

17. Apparatus as recited in claim 16, in which said means for introducing combustion air to said gases and particles include a second generally tubular wall received within said first generally tubular wall and containing and defining said inner chamber and spaced from said first generally tubular wall to form therewith an essentially annular combustion air feed passage along which combustion air flows from a first end of said first generally tubular wall to a combustion location, there being aperture means at said combustion location through which said combustion air flows to mix with said high temperature gases and entrained particles.

18. Apparatus as recited in claim 17, including an outlet communicating with said maximum diameter portion of said outer chamber and adapted to withdraw accumulated non-combustible particles therefrom, and valve means for controlling discharge of non-combustible particles through said outlet.

19. Apparatus comprising:

a structure forming a chamber;

first means for introducing a pressurized transport gas carrying entrained solid combustible particles into said chamber at a location to flow essentially circularly therein about essentially a predetermined axis;

second means for introducing a pressurized drive gas into said chamber at a location and velocity and in a direction to mix with said transport gas and drive it and the entrained particles rapidly about said axis and in a manner causing said particles to collide and be reduced in size with elevation of the gases and particles to a high temperature but without complete combustion of the particles;

said chamber having a generally annular radially outer wall along which said gases and particles move essentially circularly and which has a maximum diameter portion and inwardly facing surfaces at opposite axial sides of said maximum diameter portion extending generally annularly about the chamber and progressively increasing in diameter as they advance axially toward one another, and outlet means for discharging said mixture of high temperature gases and entrained finely divided combustible particles from a radially inner part of said chamber.

20. Apparatus as recited in claim 19, in which said inwardly facing surfaces, as viewed in axial section, are disposed at an angle of between about 50° and 130° to one another.

21. Apparatus as recited in claim 19, in which said second means introduce said drive gas into said chamber essentially tangentially and at essentially the location of said maximum diameter portion thereof.

* * * * *